US009222719B2

(12) United States Patent
Bortoletto et al.

(10) Patent No.: US 9,222,719 B2
(45) Date of Patent: Dec. 29, 2015

(54) FLEXIBLE WICK AS WATER DELIVERY SYSTEM

(71) Applicant: Whirlpool Corporation, Benton Harbor, MI (US)

(72) Inventors: Anderson Bortoletto, Waunakee, WI (US); Rameet Singh Grewal, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/173,181

(22) Filed: Feb. 5, 2014

(65) Prior Publication Data

US 2014/0145006 A1 May 29, 2014

Related U.S. Application Data

(63) Continuation of application No. 12/730,331, filed on Mar. 24, 2010, now abandoned.

(51) Int. Cl.
*F25D 17/04* (2006.01)

(52) U.S. Cl.
CPC ..... *F25D 17/042* (2013.01); *F25D 2317/0413* (2013.01); *F25D 2317/04131* (2013.01); *F25D 2323/122* (2013.01)

(58) Field of Classification Search
CPC ..... F25D 17/042; F25D 27/0413; F25D 2323/122; F25D 23/12; F25D 2317/04131
USPC ..... 62/274, 91
See application file for complete search history.

(56) References Cited

U.S. PATENT DOCUMENTS

| | | | | |
|---|---|---|---|---|
| 2,502,893 | A * | 4/1950 | Schmidt et al. | 62/281 |
| 2,927,078 | A * | 3/1960 | Nathan | 507/90 |
| 3,901,443 | A | 8/1975 | Mitsui et al. | |
| 4,109,863 | A | 8/1978 | Olson et al. | |
| 4,301,093 | A | 11/1981 | Eck | |
| 4,319,155 | A | 3/1982 | Nakai et al. | |
| 4,336,509 | A | 6/1982 | Bernitz | |
| 4,582,654 | A | 4/1986 | Karnicky et al. | |
| 4,612,777 | A | 9/1986 | Noma et al. | |
| 4,630,451 | A | 12/1986 | Kishimoto | |
| 4,702,418 | A | 10/1987 | Carter et al. | |
| 4,731,204 | A | 3/1988 | Noma et al. | |
| 4,738,806 | A | 4/1988 | Noma et al. | |
| 4,753,579 | A | 6/1988 | Murphy | |
| 4,793,339 | A | 12/1988 | Matsumoto et al. | |

(Continued)

FOREIGN PATENT DOCUMENTS

| | | | |
|---|---|---|---|
| EP | 0389665 | A1 | 10/1990 |
| JP | 2011045817 | A | 3/2011 |
| JP | 2011067769 | A | 4/2011 |

*Primary Examiner* — Ljiljana Ciric
*Assistant Examiner* — Alexis Cox

(57) ABSTRACT

A refrigerator with a main supply fluid tank and a secondary reservoir supplied with fluid from the main supply fluid tank, with secondary reservoir having a maximum, controlled height of fluid. The refrigerator has an atomizer with fluid from the secondary reservoir which discharges the fluid provided from the secondary reservoir in an atomized spray to at least a portion of the refrigerator, and a flexible wick between the secondary reservoir and the atomizer and in fluid communication with both the secondary reservoir and the atomizer. Additionally, the atomizer has a piezo element located in a piezo reservoir to hold fluid next to the piezo element, wherein the piezo reservoir is provided with fluid from the secondary reservoir via the flexible wick.

20 Claims, 9 Drawing Sheets

(56) References Cited

U.S. PATENT DOCUMENTS

| | | | | |
|---|---|---|---|---|
| 4,815,661 | A | 3/1989 | Anthony | |
| 4,877,989 | A | 10/1989 | Drews et al. | |
| 4,969,335 | A | 11/1990 | Sasaki et al. | |
| 5,138,778 | A * | 8/1992 | Brandolini | 38/77.8 |
| 5,145,113 | A | 9/1992 | Burwell et al. | |
| 5,297,734 | A | 3/1994 | Toda | |
| 5,312,281 | A | 5/1994 | Takahashi et al. | |
| 5,518,179 | A | 5/1996 | Humberstone et al. | |
| 5,657,926 | A | 8/1997 | Toda | |
| 5,716,002 | A | 2/1998 | Haack et al. | |
| 5,758,637 | A | 6/1998 | Ivri et al. | |
| 5,803,362 | A | 9/1998 | Fraccaroli | |
| 5,974,815 | A * | 11/1999 | Hwang et al. | 62/176.4 |
| 6,085,740 | A | 7/2000 | Ivri et al. | |
| 6,247,525 | B1 | 6/2001 | Smith et al. | |
| 6,293,474 | B1 * | 9/2001 | Helf et al. | 239/102.2 |
| 6,296,196 | B1 | 10/2001 | Denen et al. | |
| 6,378,780 | B1 | 4/2002 | Martens, III et al. | |
| 6,390,378 | B1 | 5/2002 | Briscoe, Jr. et al. | |
| 6,439,474 | B2 | 8/2002 | Denen | |
| 6,467,476 | B1 | 10/2002 | Ivri et al. | |
| 6,543,701 | B1 | 4/2003 | Ho | |
| 6,640,804 | B2 | 11/2003 | Ivri et al. | |
| 6,651,650 | B1 | 11/2003 | Yamamoto et al. | |
| 6,821,660 | B2 | 11/2004 | Andrews et al. | |
| 7,174,888 | B2 | 2/2007 | Ivri et al. | |
| 7,401,469 | B2 | 7/2008 | Joshi et al. | |
| 7,547,004 | B2 | 6/2009 | Hsu | |
| 7,610,118 | B2 | 10/2009 | Schramm et al. | |
| 7,610,769 | B2 | 11/2009 | Tain et al. | |
| 8,528,355 | B2 | 9/2013 | Bortoletto et al. | |
| 8,548,481 | B2 | 10/2013 | Reudink | |
| 9,004,369 | B2 * | 4/2015 | Bortoletto et al. | 236/44 C |
| 2001/0051118 | A1 | 12/2001 | Mosso et al. | |
| 2002/0064497 | A1 | 5/2002 | Horne et al. | |
| 2006/0243820 | A1 | 11/2006 | Ng | |
| 2008/0099572 | A1 | 5/2008 | Tollens et al. | |
| 2008/0112893 | A1 | 5/2008 | Arai et al. | |
| 2008/0217430 | A1 | 9/2008 | Feriani et al. | |
| 2008/0233001 | A1 | 9/2008 | Ricciardi et al. | |
| 2008/0290189 | A1 | 11/2008 | Levi | |
| 2009/0001200 | A1 | 1/2009 | Imahori et al. | |
| 2009/0054116 | A1 | 2/2009 | Hakunti et al. | |
| 2009/0065485 | A1 | 3/2009 | O'Neill et al. | |
| 2009/0148342 | A1 | 6/2009 | Bromberg et al. | |
| 2009/0159720 | A1 | 6/2009 | Fang et al. | |
| 2010/0236269 | A1 * | 9/2010 | Mamemoto et al. | 62/331 |
| 2011/0232304 | A1 | 9/2011 | Bortoletto et al. | |
| 2011/0232321 | A1 | 9/2011 | Bortoletto et al. | |
| 2011/0233289 | A1 | 9/2011 | Bortoletto et al. | |
| 2011/0236544 | A1 | 9/2011 | Bortoletto et al. | |
| 2012/0017630 | A1 * | 1/2012 | Okabe et al. | 62/407 |
| 2012/0126041 | A1 | 5/2012 | Nunomura et al. | |
| 2012/0137720 | A1 * | 6/2012 | Ueda et al. | 62/407 |
| 2015/0204555 | A1 * | 7/2015 | Grewal et al. | 236/44 C |

* cited by examiner

FLEXIBLE WICK AS WATER DELIVERY SYSTEM

BACKGROUND OF THE INVENTION

The presently described technology relates generally to the provision of water to the interior of a refrigerator. Further, aspects of the presently described technology relate generally to the use of a flexible wick as a water delivery system in a refrigerator.

BRIEF SUMMARY OF THE INVENTION

Certain embodiments of the presently described technology provide methods and systems for providing water for atomization in a refrigerator from a water source to an atomizer via a flexible wick.

Certain embodiments provide a refrigerator for cooling and humidifying at least a portion of the refrigerator. The refrigerator includes a main supply fluid tank, a secondary reservoir supplied with fluid from the main supply fluid tank, an atomizer provided with fluid from the secondary reservoir, and a flexible wick for providing fluid transfer from the secondary reservoir to a location proximate to the atomizer. The secondary reservoir has a maximum, controlled height of fluid. The atomizer discharges the fluid provided form the secondary reservoir in an atomized spray to at least a portion of the refrigerator.

The maximum controlled height of fluid in the secondary reservoir is not greater than approximately three inches. Further, in certain embodiments, the atomizer comprises a piezo element, and the flexible wick is securely attached to the piezo element. In certain other embodiments, the atomizer comprises a piezo element located in a piezo reservoir adapted to hold fluid proximate to the piezo element, and the flexible wick is in fluid communication with the piezo reservoir, wherein the piezo reservoir is provided with fluid from the secondary reservoir via the flexible wick.

The refrigerator includes an atomizer housing and a wick guide. The atomizer housing is configured for mounting the atomizer and the wick guide. The wick guide is configured for position the flexible wick proximate to the atomizer.

The refrigerator may also include a secondary reservoir supply valve that is operable to control the supply of fluid from the main supply tank. Optionally, a feature located proximate the secondary reservoir may actuate the secondary reservoir supply valve.

The atomizer may be located at a greater height than the secondary reservoir. The refrigerator may comprise a plurality of atomized compartments. Each atomized compartment may comprise a compartment atomizer, and each compartment may have a compartment wick for providing fluid to that compartment. Further, the refrigerator may comprise a main wick leading from the secondary reservoir, and an auxiliary wick that leads from the main wick to one of the compartments of the refrigerator.

The refrigerator may also include a docking station for accepting the main tank, with the secondary reservoir integrated into the docking station. The refrigerator may comprise a modular atomization unit. The modular atomization unit may comprise the main tank, the secondary reservoir, the atomizer, and the flexible wick. In certain embodiments, the modular atomization unit is removable from the refrigerator as a unit. Further, the refrigerator may comprise an atomization compartment, and the modular atomization unit is located proximate to an upper surface of the atomization compartment. Optionally, the modular atomization unit may be located proximate to a side wall of the refrigerator.

Certain embodiments of the presently described technology provide a removable, modular atomization unit for a refrigerator for humidifying at least a portion of the refrigerator. The modular atomization unit includes a secondary reservoir adapted to accept fluid from a main supply tank, an atomizer provided with fluid from the secondary reservoir, a flexible wick providing fluid transfer from the secondary reservoir to a location proximate to the atomizer. The secondary reservoir has a maximum, controlled height of fluid. The atomizer is adapted to discharge the fluid provided from the secondary reservoir in an atomized spray to at least portion of the refrigerator when the modular atomization unit is deployed in the refrigerator. The modular atomization unit is adapted to be added to or removed form the refrigerator as a unit. In certain embodiments, the modular atomization unit further includes the main supply tank that provides fluid to the secondary reservoir.

Certain embodiments of the presently described technology provide a removable, modular atomization unit for a refrigerator for humidifying at least a portion of the refrigerator. The modular atomization unit includes a main supply tank, a docking station that receives that main supply tank, an atomizer unit accepted by the docking station, and a flexible wick for providing fluid transfer from the secondary reservoir to a location proximate to the atomizer. The docking station includes an integral secondary reservoir adapted to accept fluid from a main supply tank, and the secondary reservoir has a maximum, controlled height of fluid. The atomizer unit includes an atomizer that is provided with fluid from the secondary reservoir and is adapted to discharge the fluid provided in an atomized spray to at least a portion of the refrigerator when the modular atomization unit is deployed in the refrigerator. The modular atomization unit is adapted to be added to or removed from the refrigerator as a unit.

Figure 1:
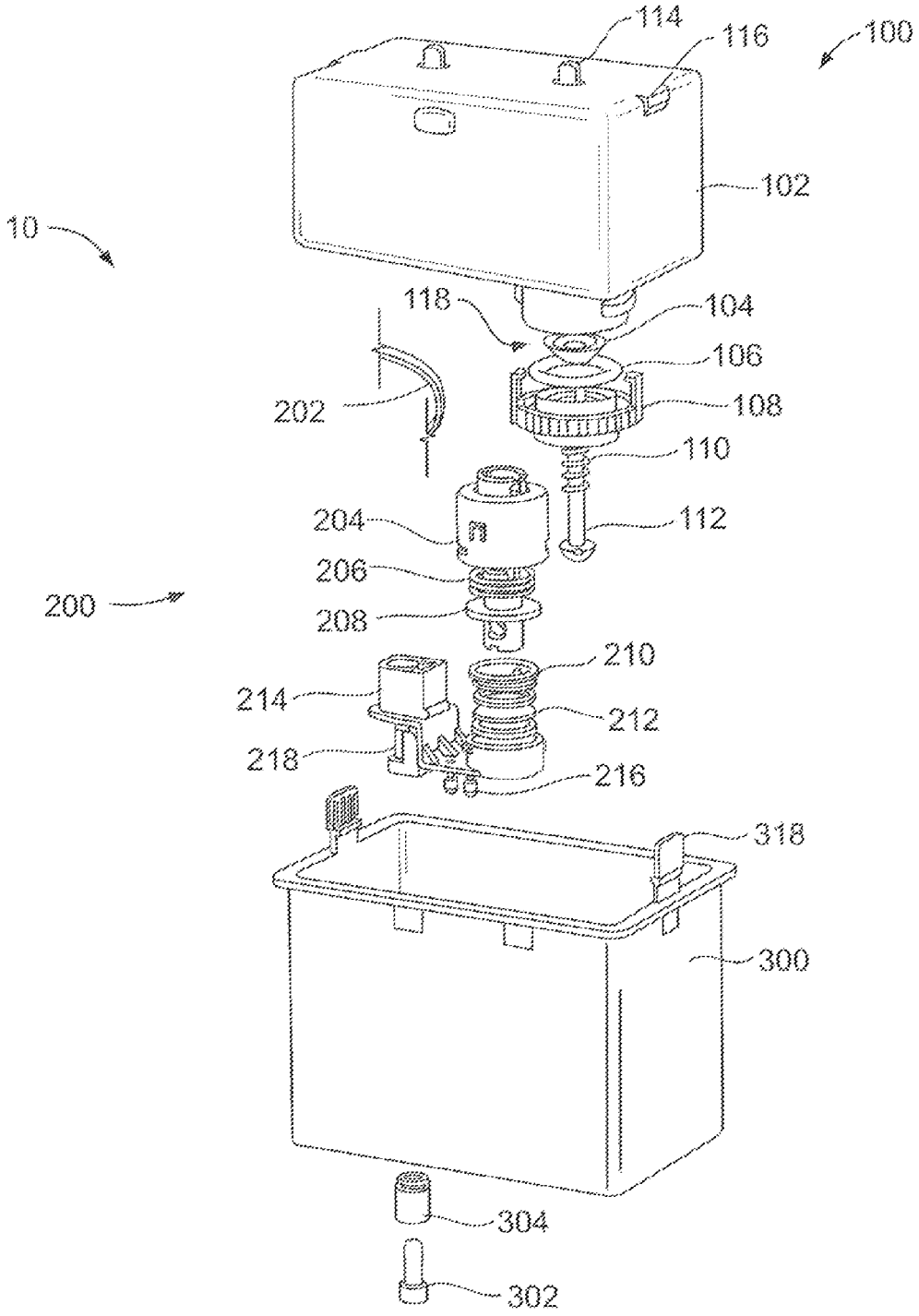
FIG. 1 illustrates an atomization unit formed in accordance with an embodiment of the presently described technology.

The foregoing summary, as well as the following detailed description of certain embodiments of the presently described technology, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Refrigerators are used to preserve food, maintain freshness, and prolong the shelf life of food. Certain foods benefit from the provision of water (high relative humidity) to help prolong their shelf life in a refrigerator. Certain conventional refrigerator designs do not provide for the addition of a fluid to help preserve freshness, or may provide such addition of fluid in inefficient, inflexible, and/or ineffective ways. The design, construction, and arrangement of many refrigerators places limitations on the placement and effective use of water delivery systems.

One method of providing a spray of water in various applications is the use of an atomizer that provides a fine spray of fluid. Such atomizers have limitations on their use, availability, or practical application. For example, certain atomizers have requirements for how fluid may be supplied to them, limiting their practical usefulness in certain applications. As an example, certain atomizers suffer leakage and/or other improper functioning when provided with water at too high of a pressure.

It has been identified or appreciated by applicants that the challenge remains of providing improved refrigerators and/or improved delivery of a spray of fluid in connection with refrigerators. Applicants now address those challenges with the presently described technology.

Certain aspects of the presently described and claimed technology provide one or more systems and methods for delivering fluid to an atomizer for humidifying at least a portion of a refrigerator, including delivering fluid to an atomizer via a flexible wick.

FIG. 1 illustrates an atomization unit 10 formed in accordance with an embodiment of the presently described technology. The illustrated atomization unit 10 is a modular design that is configured and adapted to be added to or removed from a refrigerator as a unit. The illustrated atomization unit 10 comprises a water tank assembly 100, a water delivery assembly 200, and a docking station 300. In the illustrated embodiment, the docking station 300 is adapted to securely receive the water tank assembly 100 and the water delivery assembly 200. In turn, the docking station 300 may be securely mounted in a refrigerator.

Figure 3:
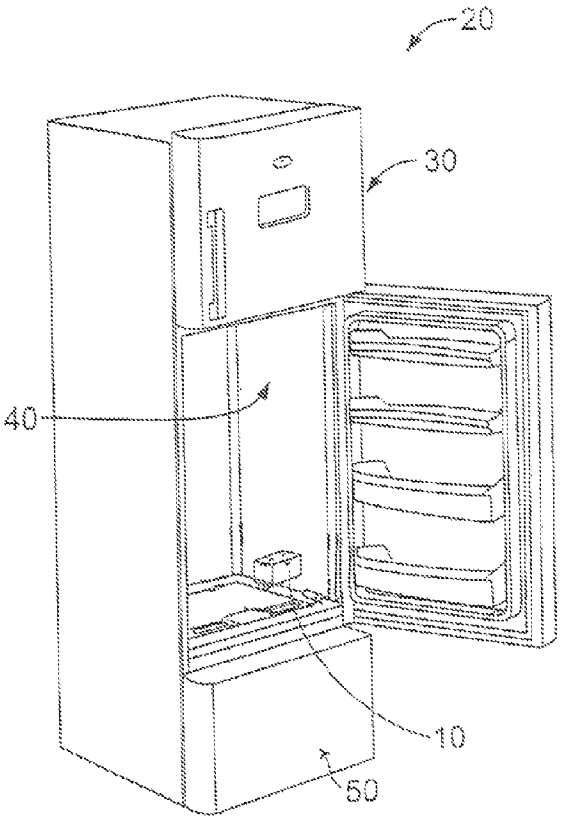
FIG. 3 illustrates a refrigerator to which the atomization unit of FIG. 1 may be added to or removed from, with the atomization unit being removed from the refrigerator.
Figure 2:
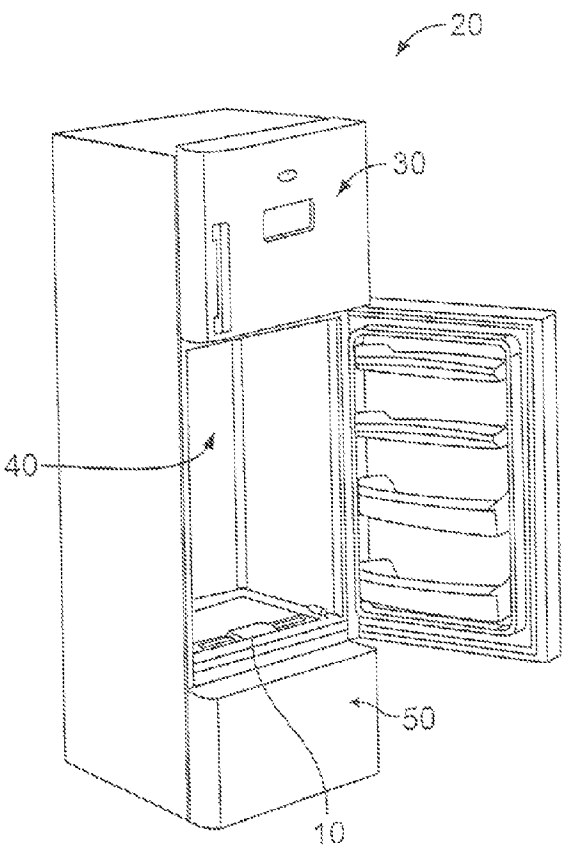
FIG. 2 illustrates a refrigerator to which the atomization unit of FIG. 1 may be added to or removed from, with the atomization unit in place in the refrigerator.

FIGS. 2 and 3 illustrate a refrigerator 20 to which the atomization unit 10 may be added to or removed from. In FIG. 2, the atomization unit 10 is shown in place, in an assembled condition, in the refrigerator 20. In FIG. 3, the atomization unit 10 is illustrated as being removed from the refrigerator 20. The atomization unit 10 may be removed from the refrigerator 20 for service, maintenance, or replacement. The atomization unit 10 may be removed from the refrigerator 20 to be refilled with a fluid, such as water. In other embodiments, the atomization unit 10 may be re-fillable without removal from the refrigerator, such as by plumbing provided within the refrigerator 20, or by a user pouring water into the atomization unit 10, or, as another example, by the attachment of a replaceable bottle or other filling device to the atomization unit 10. The atomizer unit 10 may have a footprint of, for example, about 75 millimeters by about 120 millimeters. The relatively small footprint of the atomizer unit 10 and/or the modularity of the atomizer unit 10 also allow for easier retrofitting to a refrigerator not previously designed for use with an atomizer unit to accept and use the atomizer unit 10.

For the illustrated embodiment, the refrigerator 20 includes a freezer compartment 30 located at a generally higher elevation, a refrigeration compartment 40 located at a generally intermediate level, and a refrigeration/humidification compartment 50 located at a generally lower level. The atomization unit 10 is securable at an intermediate position between the refrigeration compartment 40 and the refrigeration/humidification compartment 50, and disperses a spray of fluid generally downwardly into the refrigeration/humidification compartment 50. In such an arrangement, for example, in some embodiments the atomization unit may be supplied with water from a defrosting process in a compartment located at a higher level, the water being gravity fed to the atomization unit 10. Other refrigeration arrangements may be employed in other embodiments. As an example, an atomization unit may be located proximate a side wall of a refrigeration compartment. Additionally or alternatively, the refrigerator compartment and atomization unit may be configured and adapted so that some subcompartments of a larger compartment are supplied with atomized fluid and some are not, or further that subcompartments may be supplied with atomized fluid at different rates or amounts. Such subcompartments may be defined, for example, by bins, trays, and/or shelves dispersed throughout a compartment. The various compartments may be differently sized and/or arranged in other embodiments. As an example, a refrigerator may not comprise a separate refrigerator/humidification compartment, but may instead comprise a freezer unit and a refrigerator unit arranged in a side-by-side fashion, with an atomization unit providing humidification to all or part of the refrigeration unit.

Figure 4:
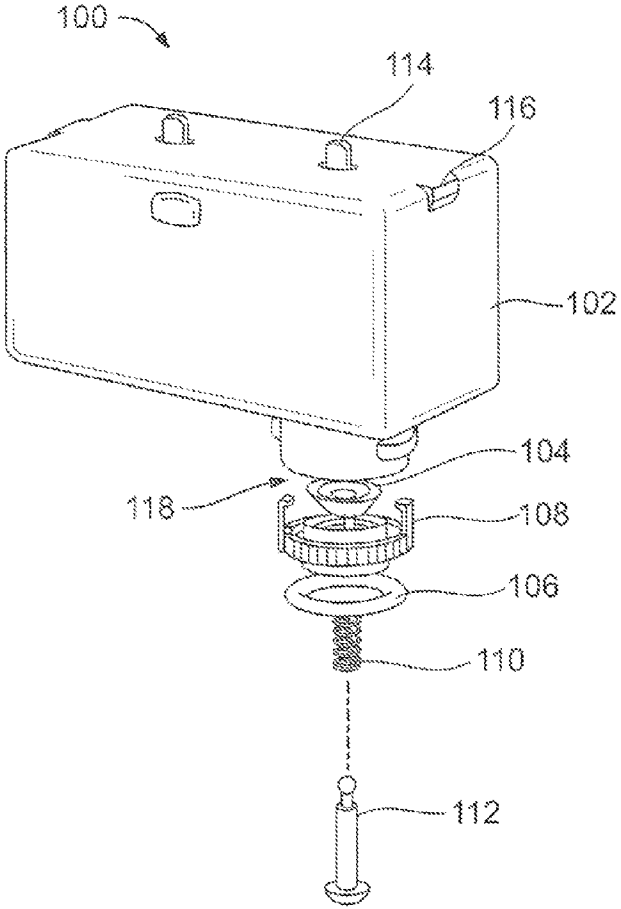
FIG. 4 illustrates an exploded perspective view of a water tank assembly formed in accordance with an embodiment of the presently described technology.

Returning to FIG. 1, as also indicated above, the atomization unit 10 comprises a water tank assembly 100, a water delivery assembly 200, and a docking station 300. FIG. 4 illustrates an exploded perspective view of the water tank assembly 100. The water tank assembly 100 includes a water tank 102, a poppet valve seal 104, an o-ring 106, a water tank cap 108, a poppet valve spring 110, a poppet valve 112, ears 114, and tabs 116.

The water tank 102 is configured and adapted to hold a volume of fluid. The water tank 102 is an example of a primary fluid reservoir or main supply fluid tank. As such, the water tank 102 should be constructed to be water tight, especially around its sides and bottom, to prevent leakage. The water tank 102 comprises one or more locations for the controlled entry and/or exit of fluid. Further, in the illustrated embodiment, the water tank 102 is configured to be airtight when the opening 118 is closed to the entry of air, for example, by being shut by a valve or submersed below a liquid level. The illustrated water tank 102 comprises an opening 118 located proximate the bottom of the water tank 102, which is sized and adapted to accept the water tank cap 108 and related components to allow for the controlled dispensing of water from the water tank 102. The water tank 102 may be inverted, with the water tank cap 108 removed, to be manually filled with water. In other embodiments, for example, the water tank 102, may be re-filled manually through a separate or additional cap accessible when the atomizer unit 10 is in place in the refrigerator, by a plumbing feed from water from another portion of the refrigerator or an external supply, and/or by a replaceably attachable supply such as a bottle. In other embodiments a replaceable supply such as a bottle may act as a supply of water without the use of a separate primary water tank.

In the illustrated embodiment, the ears 114 are located proximate to an external top surface of the water tank 102, and provide a convenient access point for handling the atomizer unit 10 during installation to and removal from the refrigerator 20. The ears 114 also provide a convenient access point for removing and/or installing the water tank 102 to the docking assembly 300. The tabs 116 are configured to help guide the water tank 102 into place into the docking station 300, and are configured to help secure the water tank 102 in place in the docking station 300.

As also previously mentioned, the water tank assembly 100 includes a poppet valve seal 104, an o-ring 106, a water tank cap 108, a poppet valve spring 110, and a poppet valve 112. The water tank cap 108 is sized and configured to cooperate with the opening 118 of the water tank 102 to allow fluid flow when the poppet valve 112 is open, and to prevent fluid flow when the poppet valve 112 is closed. The poppet valve seal 104, o-ring 106, water tank cap 108, and poppet valve spring 110 cooperate to prevent fluid flow when the poppet valve 112 is in a closed position. For example, the seals and o-ring are configured to help provide a waterproof barrier. The poppet valve spring 110 is configured to urge the poppet valve 112 in a closed position, and the poppet valve seal 104 is mounted to the poppet valve 112 so that the poppet valve seal 104 moves with the poppet valve 112. In the illustrated embodiment, the poppet valve seal 104 is generally funnel shaped and configured to prevent flow through the water tank cap 108 when the poppet valve 112 is in a closed position. The funnel shape helps properly seat the poppet valve seal 104 with the assistance of downward pressure provided by a water column above it, when the poppet valve 112 is in a closed position. As shown in FIGS. 1 and 4, the poppet valve spring 110 is configured to bias the poppet valve 112 downward, thus drawing the poppet valve seal 104 down over an opening in the water tank cap 108. The poppet valve 112 is opened by pressing upward on the poppet valve 112 against the urging of the poppet valve spring 110, thereby moving the poppet valve seal 104 (which is mounted to the poppet valve 112) upward and away from the opening in the water tank cap 108, thereby allowing fluid flow. Thus, when fluid flow is desired, the poppet valve 112 may be urged against the poppet valve spring 110 to an open position to allow fluid flow through the water tank cap 108. Once fluid flow is desired to be stopped, the poppet valve 112 may be returned to a closed position, where the poppet valve spring 110 will help close it and maintain it in place. In other embodiments, different valve arrangements and/or cap opening/closing arrangements and/or fluid flow mechanisms may be employed.

Figure 5:
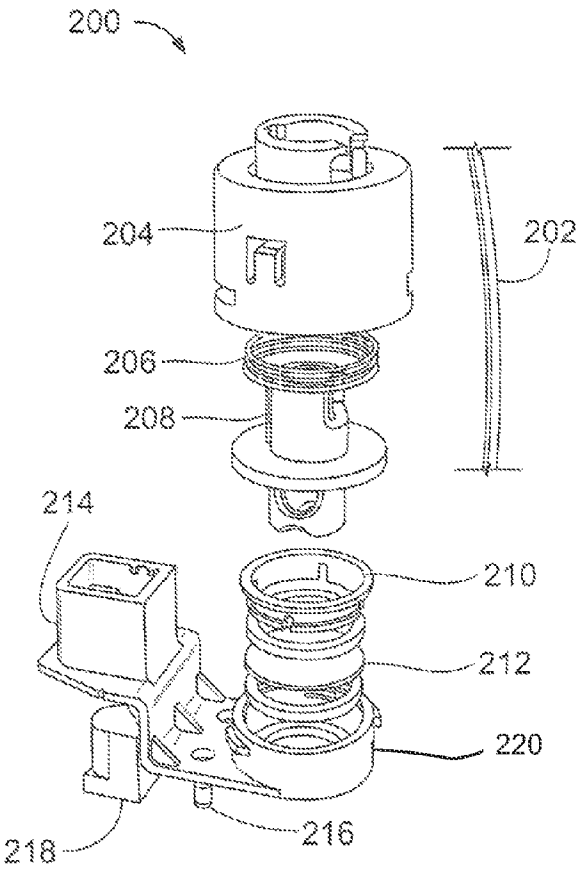
FIG. 5 illustrates an exploded perspective view of a water delivery assembly formed in accordance with an embodiment of the presently described technology.

FIG. 5 illustrates an exploded perspective view of the water delivery assembly 200. In the illustrated embodiment, the water delivery assembly includes a wick 202, a wick holder 204, a wick spring 206, a wick plunger 208, a piezo compression ring 210, a piezo cell 212, a piezo casing 214, a piezo reservoir 220, and light emitting diodes (LEDs) 216. The water delivery assembly 200 in the illustrated embodiment is modular, and may be assembled and removed from and/or installed into the docking station 300 as a unit.

The wick 202 is configured to be a flexible member with sufficient absorbency to be able to deliver fluid from a reservoir to the piezo cell 212. The wick 202, for example, may be constructed of a cotton material, such as material from Pepperell Braiding Co., which can range in size, for example, from about 1/16 inch to about ½ inch and may be capable of drawing water up to about 8 inches. The wick holder 204, wick spring 206, and wick plunger 208 are configured and adapted to maintain one end of the wick 202 in proximity to the piezo cell 212, so that the wick 202 may act as a fluid conduit to the piezo cell 212. The wick holder 204 and/or other components provide an example of a wick guide. The wick 202 is positioned such that one end of the wick 202 is in fluid communication with a source of fluid, and the other end is proximate to the piezo cell 212 and within the piezo reservoir 220, so that the fluid is provided from a source of fluid to the piezo cell 212 via the wick 202. In certain embodiments, the wick is securely attached to the piezo cell, or element. In other embodiments, the wick is not securely attached to the piezo cell, but is positioned close enough to the piezo cell to provide water or other fluid. For example, the piezo casing may define a piezo reservoir that is supplied by the wick and maintains a volume of water proximate to the piezo cell.

The piezo casing 214 and piezo compression ring 210 cooperate to help maintain the piezo cell 212 in a desired position. The piezo casing 214 also includes a female docking pin 218 adapted to help secure the water delivery assembly 200 in place in the docking assembly 300. The piezo cell 212 is a relatively thin, perforated disk that, when stimulated vibrates, whereby fluid from a top surface of the piezo cell 212 is drawn through the perforations and distributed in an atomized spray from a bottom surface of the piezo cell 212. For example, the piezo cell 212 may be about 20 millimeters in diameter and between about 0.65 and about 0.83 millimeters thick. The perforations may be sized, for example, from about 8 to about 12 microns. The piezo cell 212 may have an activating frequency of about 110 Kilohertz, and may provide a misting rate of greater than about 10 cubic centimeters per hour. Perforations above about 12 microns may increase the possibility of leakage, while perforations under about 6 microns may contribute to clogging, thereby shortening the effective life. This atomized fluid may then be used to provide moisture in an easily accepted form to foodstuffs in an appropriate compartment that is supplied with an atomizer. The wick holder 204 and related components cooperate with the piezo casing 214 and related components to form a modular unit that may be handled as a unit, and helps maintain the piezo cell 212 in proper position. For example, the wick plunger 208 may urge against the piezo compression ring 210 to help maintain the piezo cell 212 in place as well as to help prevent any leakage from the water delivery assembly 200. The wick holder 204 may be snappably and removable received by the piezo casing 214. The LEDs 216 light to provide information regarding the status and/or function of the piezo cell 212. The piezo cell 212 is an example of an atomizer that may be used to provide a fine spray of fluid. Such a fine spray of fluid, such as water, may be beneficial in a refrigerator application, as certain foodstuffs advantageously absorb the water provided in such a fine spray in a more effective manner compared to certain other methods of providing water to foodstuffs. The humidity provided by the atomizer, for example, improves preservation of vegetables and other fresh foods, prevents food odor transfer to other food in refrigerator, helps maintain the color of green vegetables longer and aid nutrition retention, and improves savings due to avoiding waste of vegetables.

As shown in FIG. 1, the docking station 300 includes a male docking pin 302 and grommet 304 configured to cooperate with the female docking pin 218 to secure the water delivery unit 200 in place. The grommet 304 helps maintain water-tightness through the opening of the docking station 300 that accepts the male docking pin 302 and grommet 304. Docking station 300 also includes snaps 318 that cooperate with the ears 114 of the water tank 102 to help guide, place, and secure the water tank 102 to the docking station 300. With the water tank assembly 100 and water delivery assembly 200 in place in the docking station 300, the assembled components form a modular assembly that can be conveniently attached to and removed from the refrigerator 20. The modular design of the entire unit as well as various modular subassemblies also simplifies repairs and maintenance, as well as easing the process of retrofitting the unit to a refrigerator not originally designed to accommodate such a unit.

Figure 6:
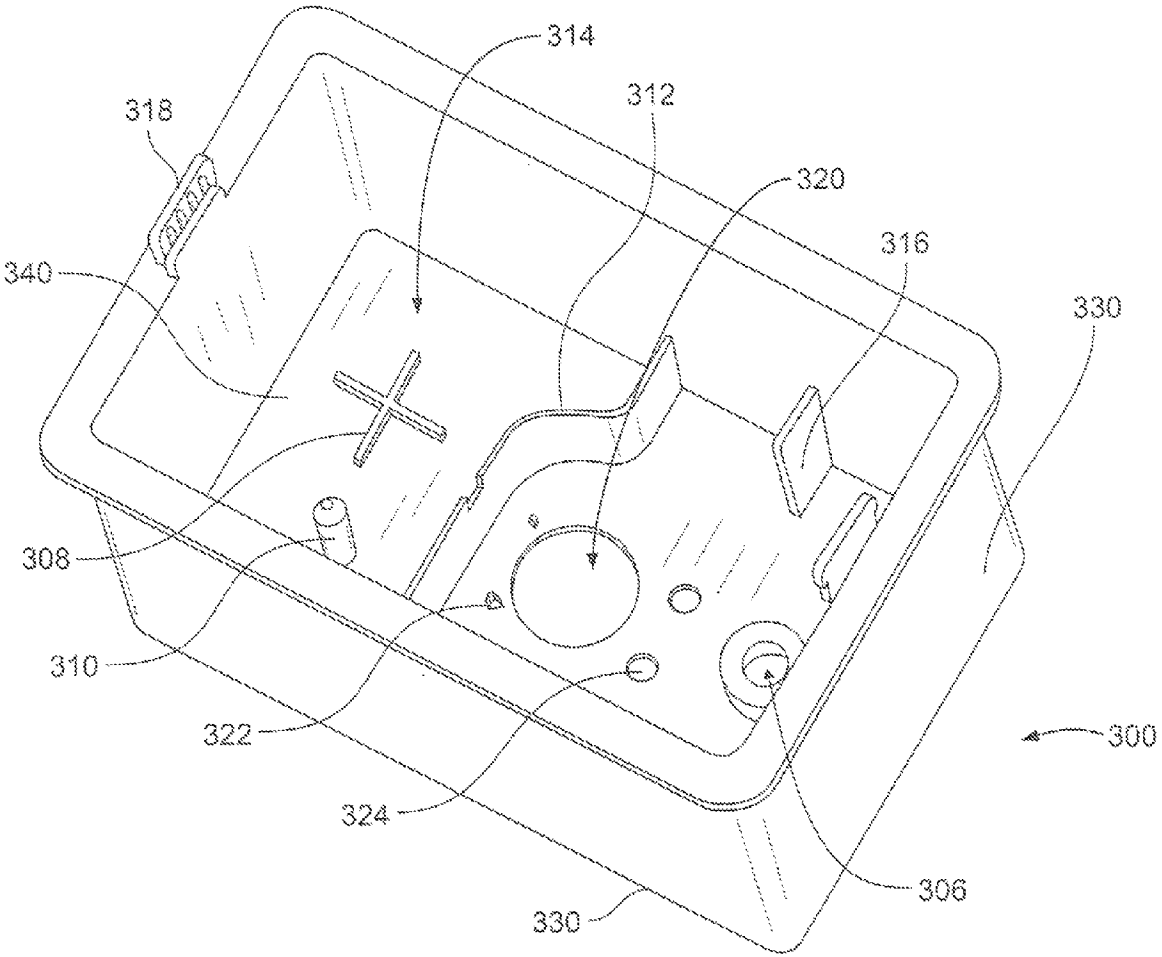
FIG. 6 illustrates a perspective view of a docking station formed in accordance with an embodiment of the presently described technology.

FIG. 6 illustrates a perspective view of a docking station 300. The docking station 300 of the illustrated embodiment includes side walls 330 that extend from a base 340 to define an open volume. The docking station 300 is configured to accept the water delivery assembly 200 and the water tank assembly 100. In the illustrated embodiment, the docking station 300 is molded as a single piece. The docking station 300 comprises a water delivery assembly mounting hole 306, a valve projection 308, a switch projection 310, a reservoir wall 312, a docking station reservoir 314, ribs 316, snaps 318, a piezo opening 320, and mounting features 322, 324.

The water delivery assembly mounting hole 306 is configured to cooperate with the female docking pin 218, male docking pin 302, and grommet 304 to help secure the water delivery assembly 200 in place in the docking station 300. Additionally, the illustrated embodiment includes mounting features 322, 324 to help guide, located, and/or secure the water delivery assembly 200 in place in the docking station 300. As shown in FIG. 6, mounting features 322 comprise raised surfaces and mounting features 324 comprise holes in the base 340 of the docking station 300. Further, the docking station 300 is configured to allow wiring for power supply and control to be connected to the water delivery assembly 200.

The valve projection 308 extends from the base 340 of the docking station 300, and is positioned and configured to press against the bottom of the poppet valve 112 when the water tank assembly 100 is lowered into place in the docking station 300. The atomization unit 10 is configured so that, when the water tank assembly 100 is securely positioned in place in the docking unit 300, the poppet valve 112 is urged upward by contact with the valve projection 308 into an open position thereby allowing fluid flow. In other arrangements, the docking station reservoir 300 (or other reservoir with which a wick is in fluid communication) may be provided with water from a source other than a water tank, such as via municipally provided water via plumbing into the refrigerator, or water obtained from a defrosting process elsewhere in the refrigerator.

The switch projection 310 extends upward from the base 340 of the docking station 300. The switch projection 310 cooperates with a reed switch (not shown) to indicate the position of the water tank 102, for example, to indicate whether or not the water tank 102 is in its secure, assembled position within the docking station 300.

The reservoir wall 312 is a generally vertical wall that extends upward from the base 340, and together with portions of the base 340 and side walls 330 defines a docking station reservoir 314. The docking station reservoir 314 is an example of a secondary reservoir that accepts fluid from a primary reservoir or main supply, such as a water tank, and from which fluid is provided to an atomizer via the wick 202. In the illustrated embodiment, the docking station reservoir 314 is integrally formed with the docking station 300. In other embodiments, a secondary reservoir that is not integrally formed with a docking station may also be employed. The reservoir wall 312 extends from the base 340 to a height that is low enough to not interfere with the placement of the water tank 102 in the docking assembly 300, but high enough to retain water in the docking station reservoir 314 without water spilling over the top of the reservoir wall 312. As will be appreciated further below, the reservoir wall 312 in the illustrated embodiment extends to a height such that its top is located at an elevation higher than the opening through the water tank cap 108 when the water tank 102 is in its secured, assembled position in the docking station 300.

The ribs 316 extend upward from the base 340 of the docking station and are configured to provide support to the water tank 102 when the water tank 102 is placed in the docking station 300. The ribs 316 also provide a positive stop to help prevent the water tank 102 from being pressed too deeply into the docking station 300 and damaging portions of the water delivery assembly 200.

The snaps 318 extend upward from the sides of the docking unit 300. The snaps are configured to be resiliently biasable, and to cooperate with the tabs 116 of the water tank 102 to secure the water tank 102 in place to the docking station 300.

The piezo opening 320 extends through the base 340 and is configured to provide an opening for the piezo cell 212, so that an atomized spray from the piezo cell 212 may be delivered to a desired location in a refrigerator.

Figure 8:
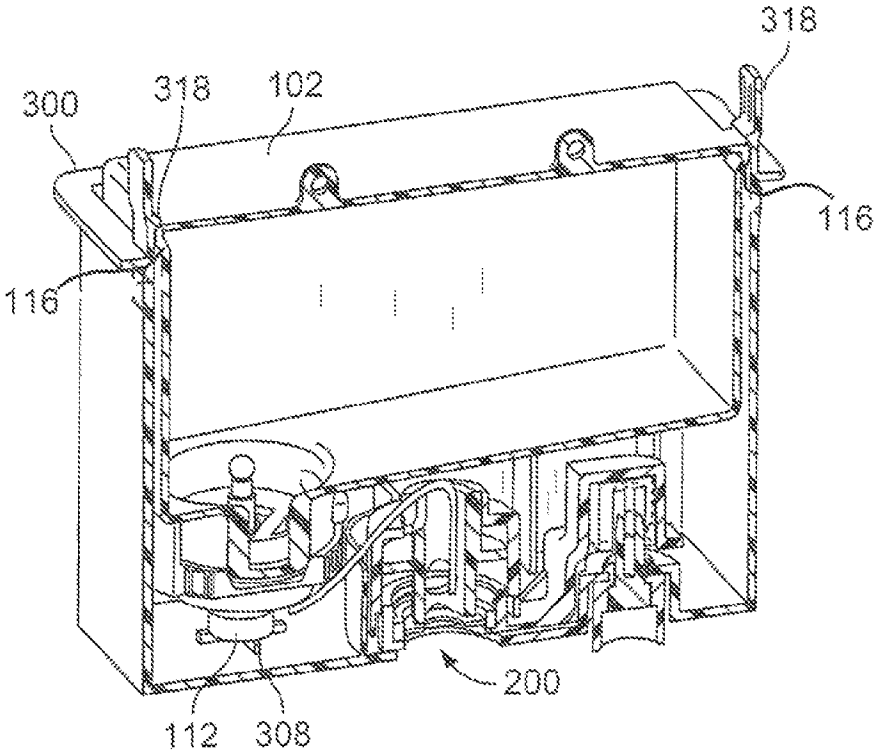
FIG. 8 illustrates a sectional view of the atomization unit of FIG. 1 with the water tank assembly securely positioned in the docking station.
Figure 7:
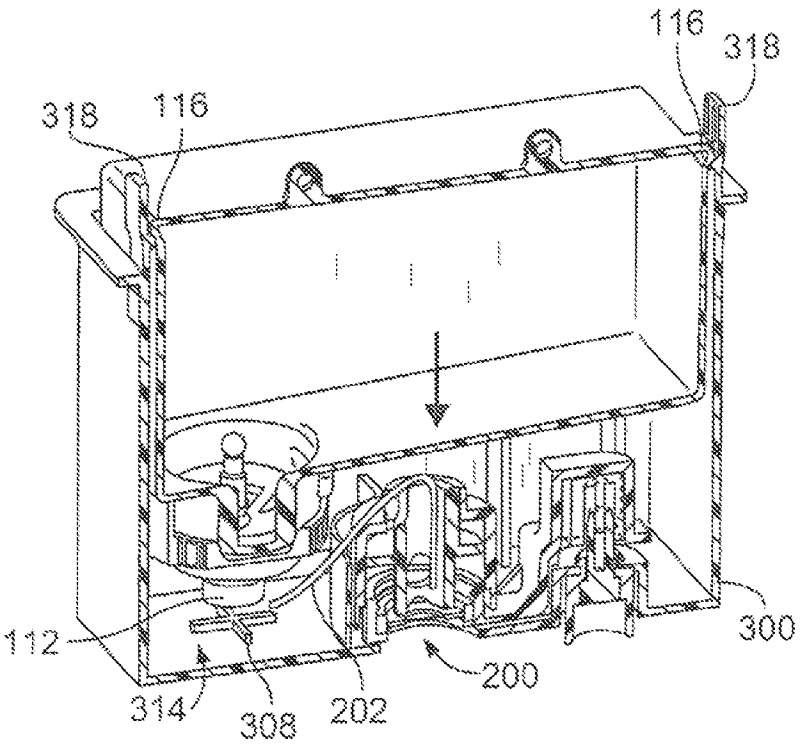
FIG. 7 illustrates a sectional view of the atomization unit of FIG. 1 as the water tank assembly is being inserted into the docking station.

The assembly of the atomization unit 10 may be accomplished as discussed below. FIG. 7 illustrates a sectional view of the atomization unit 10 as the water tank assembly 100 is being inserted into the docking station 300, and FIG. 8 illustrates a sectional view of the atomization unit 10 with the water tank assembly 100 securely positioned in the docking station 300. The water delivery system 200 may be assembled, positioned, and secured in place to the docking station 300, with one of the wick 202 proximate the piezo cell 212, and the other end of the wick 202 positioned in the docking station reservoir 314 where the wick 202 will be in fluid communication with a liquid supply to provide liquid to the piezo cell 212. The docking station 300 may then be securely positioned in the refrigerator 20, and all necessary connections made to provide power and/or control to the water delivery system 200. As an alternative, the water tank assembly 100 may be positioned in the docking station 300 before the docking station 300 is positioned in the refrigerator 20.

Before installing the water tank assembly 100, the water tank 102 may be filled with water. To fill, the water tank 102 is inverted so that the opening faces upward, and the water tank cap 108 and related components are removed from the water tank 102, providing access to the opening. A desired amount of water is then poured into the water tank 102, and the water tank cap 108 and related components are re-positioned on the water tank 102. With the water tank cap 108 securely fastened to the water tank 102 and the poppet valve spring 110 urging the poppet valve 112 into a closed position, the opening is closed and the water tank 102 is sealed, so that it may transferred without spillage.

The water tank 102 is then oriented for installation, with the water tank cap 108 oriented downward and aligned over the valve projection 308. As shown in FIG. 7, the water tank assembly 100 is then lowered in place into the docking station 300. Eventually, as the water tank assembly 100 is lowered, the poppet valve 112 will come into contact with the valve projection 308 to initiate opening of the poppet valve 112. Also, during the lowering, the tabs 116 of the water tank 102 encounter the snaps 318 of the docking station 300, and as the water tank 102 is further lowered, the tabs 116 press against the snaps 318, resiliently biasing the snaps 318 outwardly. For example, the tabs 116 may comprise sloped surfaces to assist in biasing the snaps 318 outwardly. As the water tank reaches its final, secured position, the tabs 116 pass beyond the snaps 318, allowing the snaps 318 to resiliently snap back into their original position, helping secure the water tank 102 in place.

At the same time, as the water tank 102 reaches its final, secured position, the poppet valve 112 is moved into its open position by its contact with the valve projection 308. With the poppet valve 112 in its open position, liquid flows from the water tank 102 through the opening in the water tank cap 108 into the docking station reservoir 314. Thus, the poppet valve 112 is an example of a secondary reservoir supply valve. The liquid continues to flow and fill the docking station reservoir 314 until the liquid rises to a level high enough to cover the opening in the water tank cap 108, such that the opening is not exposed to atmospheric pressure but is instead surrounded by liquid. At this point, atmospheric pressure acting on the top of the liquid in the docking station reservoir 314 is sufficient to prevent any further flow into the docking station reservoir 314. Thus, the atomization unit 10 is configured to provide a maximum, controlled height of fluid in the docking station reservoir 314. As liquid is removed from the docking station reservoir via the wick 202 (which delivers liquid to the piezo cell 212 from where it is atomized into at least a portion of a refrigerator) water from the water tank 102 will replenish the docking station reservoir 314 to maintain the water level in the docking station reservoir 314 at a height sufficient to shield the opening in the water tank cap 108 from atmospheric pressure. The atomization unit 10 may be configured to maintain the level of water in the docking station reservoir 314 below a certain height to prevent water at too high of a pressure from being delivered to the piezo cell 212. For example, certain piezo cells do not function properly when exposed to water pressure caused by a head of about 3 inches. Thus, in certain embodiments, the atomization unit 10 is configured so that the level of water in the docking station reservoir 314 is maintained at a level below about 3 inches. In other embodiments, the opening and closing of a valve from the water tank may be controlled by sensors and switches based on the level of water in the secondary reservoir. For example, the valve may be opened when the level of water falls below a certain height, and closed when the level reaches a second height. In other embodiments, sensors may send signals to control the flow of water into the docking station reservoir 314 from an external supply via plumbing into the refrigerator.

With the atomizer unit 10 in place, an atomized spray may now be provided to a desired portion or portions of a refrigerator. The atomizer unit 10 defines a fluid flow path from the water tank 102, through the water tank cap 108 and into the docking station reservoir 314, and from the docking station reservoir 314 to the piezo cell 212 via the wick 202. The piezo cell 212 then may deliver an atomized spray.

Figure 9:
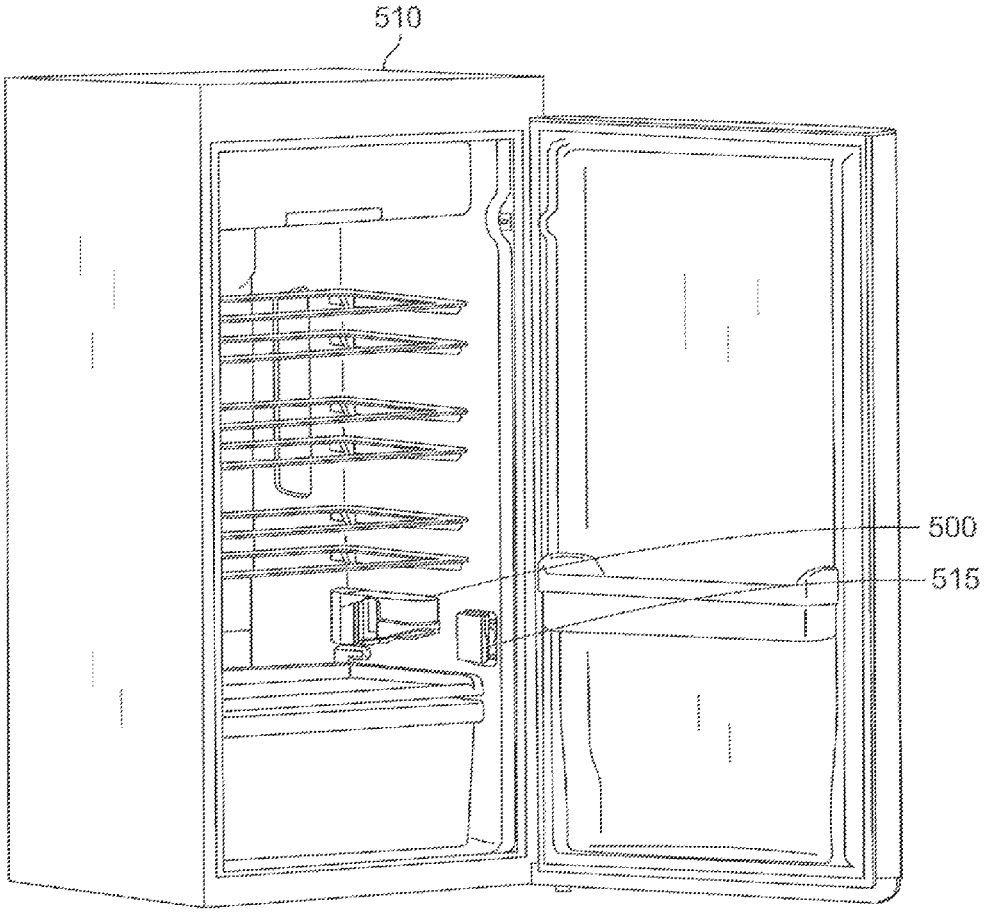
FIG. 9 illustrates an atomizer unit formed in accordance with an embodiment of the present disclosure in position in a refrigerator.

FIG. 9 illustrates another embodiment of an atomizer unit 500 in position in a refrigerator 510. As shown in FIG. 9, the atomizer unit 500, when positioned in the refrigerator 510, is positioned proximate a side wall of the refrigerator 510. While differing in some respects from the atomizer unit 10, the atomizer unit 500 may also have certain similar components to the atomizer unit 10, and may function in a generally similar manner to above discussed embodiments. As also shown in FIG. 9, the refrigerator 510 includes a control unit 515. The control unit 515 may be used to control the times at which the atomizer is turned on and off, and may optionally provide a user interface for adjusting the operating settings of the atomizer.

Figure 10:
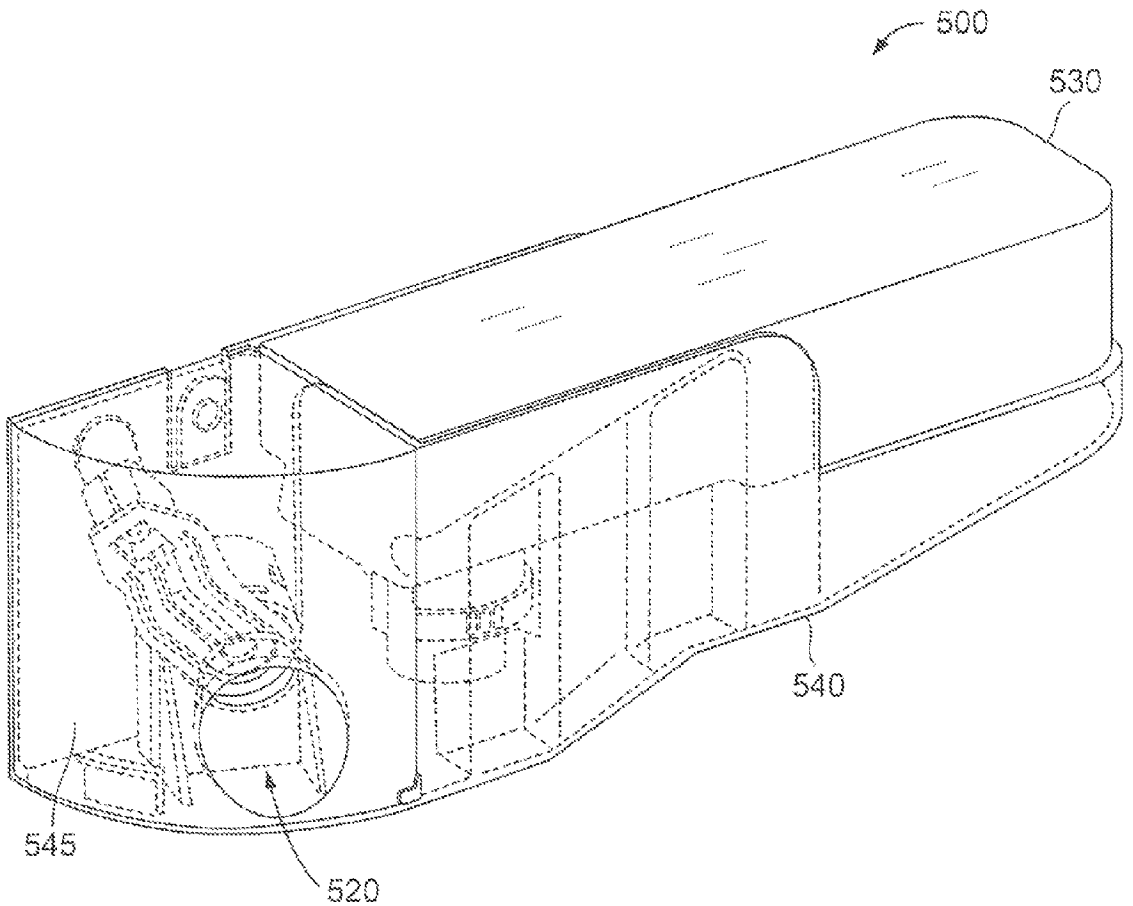
FIG. 10 illustrates a perspective view of the atomizer unit of FIG. 9.
Figure 11:
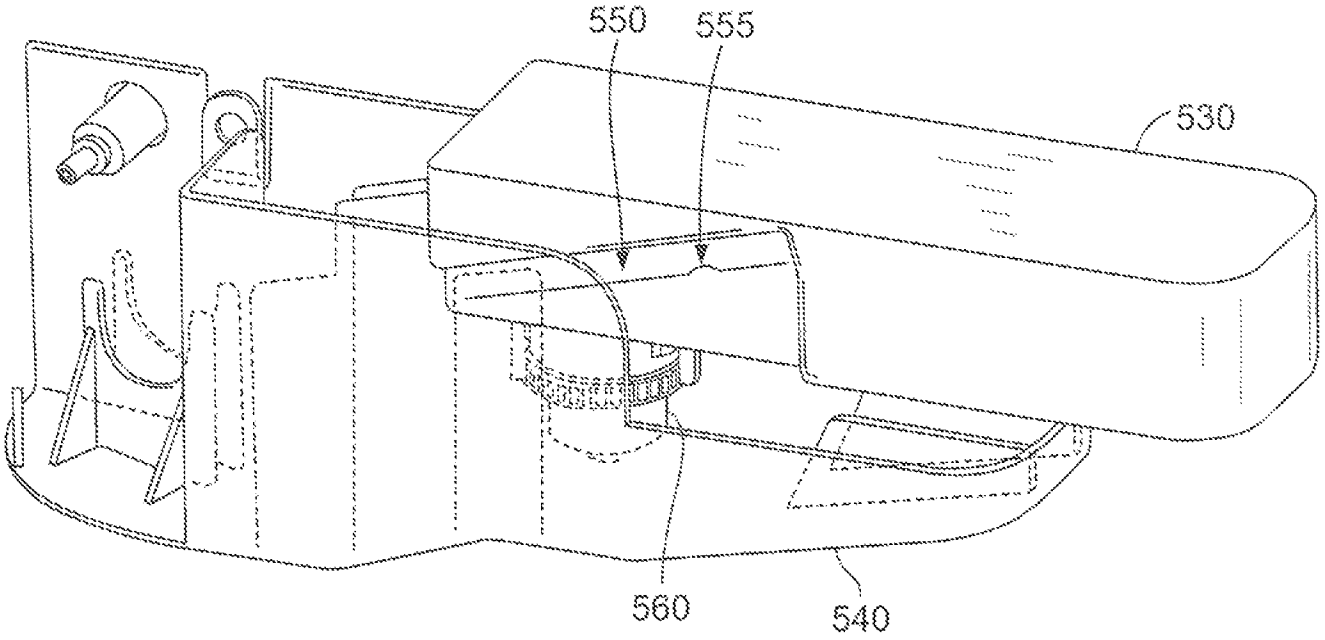
FIG. 11 illustrates a perspective view of a water tank assembly being slid into position into a docking station of the atomizer unit of FIG. 9.

FIG. 10 illustrates a perspective view of the atomizer unit 500. The atomizer unit 500 includes a water delivery assembly 520, a water tank assembly 530, a docking station 540, and a piezo cover 545 that snaps into place on the docking station 540. FIG. 11 illustrates a perspective view of the water tank assembly 530 being slid into position into the docking station 540.

As seen in FIGS. 9-11, the atomized spray from the atomizer unit 500 is dispersed at an angle from the vertical and not straight down. Also, the water tank assembly 530 includes a sliding face 550 that cooperates with the docking station 540 so that the water tank assembly 530 is slid at an angle into the docking station 540, and a locking projection 555 that helps secure the water tank assembly 530 in its final installed position. The water tank assembly 530 includes a cap assembly 560 that includes a valve allowing it to be open and closed. Water from the water tank assembly 530 is delivered to a reservoir in the docking station 540 from where water is delivered to the water delivery assembly via a flexible wick.

Various flexible wicks may be used in conjunction with different embodiments of the presently claimed and described invention. For example, in some embodiments the wick may be used to deliver fluid to an atomizer at an elevation a limited distance above the water reservoir. As will be appreciated by those skilled in the art, a wick may be used to draw a fluid upward a given distance based on, for example, the wick material and fluid being drawn.

Figure 12:
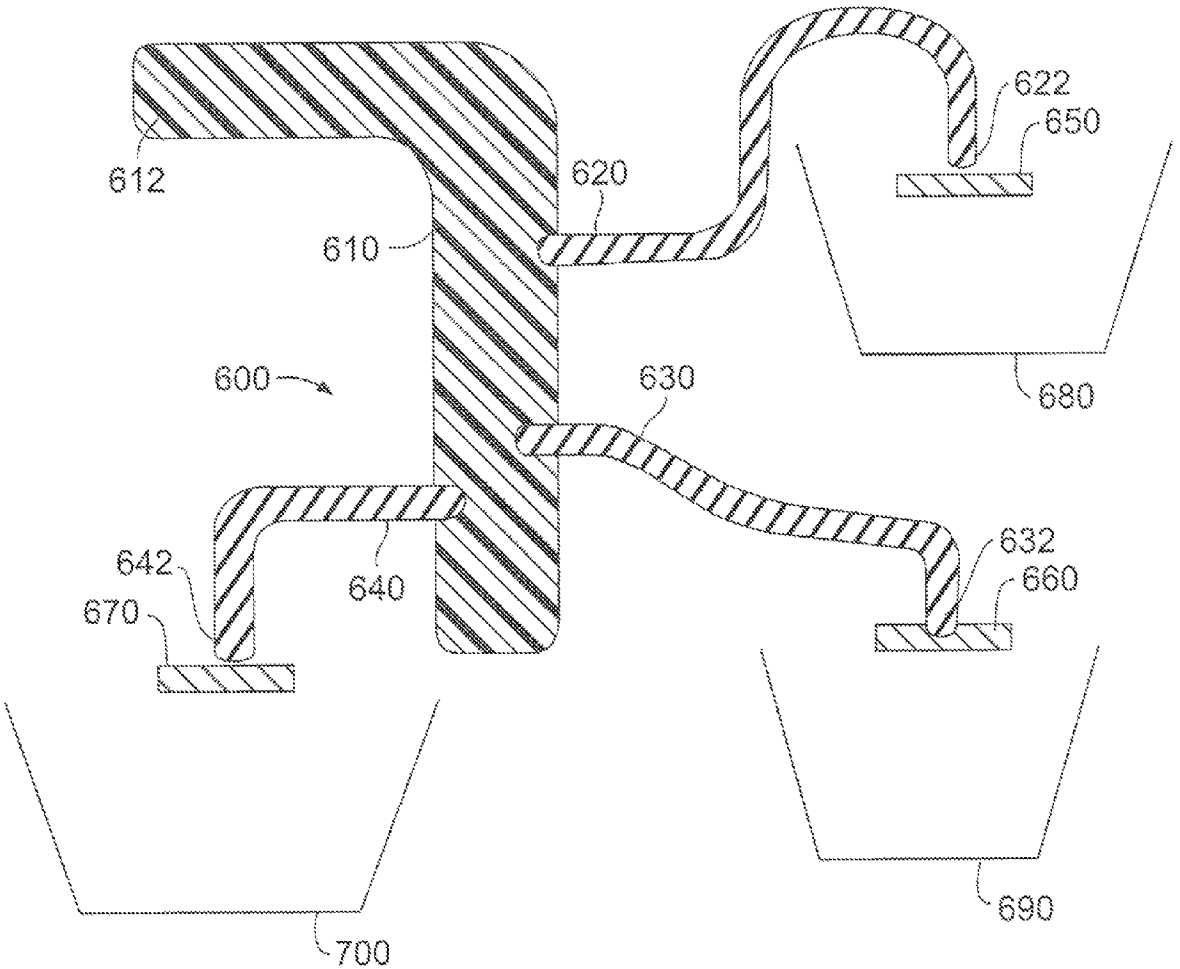
FIG. 12 illustrates a schematic view of a main wick with auxiliary wicks formed in accordance with an embodiment of the presently described technology.

FIG. 12 illustrates a view of a wick 600 formed in accordance with an embodiment of the presently described technology. The wick 600 may be used in a refrigeration system for providing fluid to a plurality of atomizers dispersed in different locations of a refrigerator. Such an arrangement can be used to provide atomization to separately located discrete portions of a refrigerator, and/or different amounts of atomization to different portions of a refrigerator, and/or atomization to different portions of a refrigerator at different times based upon, for example, different localized conditions. The wick includes a main wick 610 and auxiliary wicks 620, 630, and 640. Each of the auxiliary wicks 620, 630, and 640 provide liquid to atomizers 650, 660, and 670, respectively. The atomizers 650, 660, 670 provide an atomized spray to compartments 680, 690, 700, respectively of the refrigerator. Thus, each of the auxiliary wicks provides an example of a compartment wick, and the atomizers provide examples of compartment atomizers that are configured to deliver liquid to one of a plurality of compartments in a refrigerator. As an example, different numbers of auxiliary wicks may be used in other embodiments. As further examples, a primary wick may branch off to different locations in a refrigerator and there may be wicks that branch off from auxiliary wicks as well. In other embodiments, more than one wick and/or atomizer may provide fluid to a compartment.

In the illustrated embodiment, the main wick 610 includes a source end 612. The source end 612 is in fluid communication with a water source. Water is drawn from the source proximate the source end 612 through the main wick 610 to the auxiliary wicks 620, 630, and 640. Each of the auxiliary wicks 620, 630, and 640 include a terminal end 622, 632, and 642, respectively. Atomizers are located proximate to each of the terminal ends 622, 632, and 642. Water is provided to the atomizers from the source through the main wick from the source end 612 to the various auxiliary wicks, and then to the terminal ends of the auxiliary wicks, which provide the water to the atomizers, which may comprise, for example, piezo cells. In another embodiment, the main wick may also proceed to a terminal end that provides water to a piezo cell. Use of such a main wick and auxiliary wicks as discussed, for example, in connection with embodiments described above, allows water from a single source to be provided to different portions of a refrigerator, providing added flexibility and adjustability in water delivery.

As can be gathered from the foregoing, certain embodiments of the presently described technology thus can provide, for example, a modular assembly and/or sub-assemblies for the atomization of water in a refrigerator. Such a modular unit or units improves ease and cost of maintenance, assembly, and/or replacement. Further, certain embodiments of the presently described technology provide improved flexibility with respect to the location of water supply for an atomizer, and/or location of an atomizer or atomizers within a refrigerator. For example, multiple atomizers may be used that are supplied from a single water source, and/or atomizers can be positioned both above and below a water source. Atomizers can also be positioned at various remote distances from a water source, with water delivered via a wick. Use of multiple atomizers may allow discrete portions of a refrigerator to receive an atomized spray, as well as allow different portions to receive an atomized spray at different times and/or in different amounts.

While the presently described technology has been described with reference to certain embodiments, it will be understood by those skilled in the art that various changes may be made and equivalents may be substituted without departing from the scope of the invention. In addition, many modifications may be made to adapt a particular situation or material to the teachings of the presently described technology without departing from its scope. Therefore, it is intended that the present presently described technology not be limited to the particular embodiment disclosed, but that the presently described presently described technology will include all embodiments falling within the scope of the appended claims.

The invention claimed is:

1. A refrigerator, comprising:

a main supply fluid tank;

a secondary reservoir supplied with fluid from the main supply fluid tank, the secondary reservoir having a maximum, controlled height of fluid;

an atomizer provided with fluid from the secondary reservoir, the atomizer discharging the fluid provided from the secondary reservoir in an atomized spray to at least a portion of the refrigerator; and a flexible wick disposed between the secondary reservoir and the atomizer and in fluid communication with both the secondary reservoir and the atomizer, wherein the atomizer comprises a piezo element located in a piezo reservoir adapted to hold fluid proximate to the piezo element, wherein the piezo reservoir is provided with fluid from the secondary reservoir via the flexible wick.

2. The refrigerator of claim 1 wherein the maximum, controlled height of fluid in the secondary reservoir is not greater than approximately three inches.

3. The refrigerator of claim 1 wherein the flexible wick is securely attached to the piezo element.

4. The refrigerator of claim 1 comprising a piezo casing and a wick guide, the piezo casing being configured for mounting the atomizer and the wick guide, the wick guide being configured for positioning the flexible wick adjacent to the atomizer.

5. The refrigerator of claim 1 comprising a secondary reservoir supply valve, the secondary reservoir supply valve operable to control the supply of fluid from the main supply tank.

6. The refrigerator of claim 5 comprising a raised valve actuation element disposed within the secondary reservoir and configured to actuate the secondary reservoir supply valve when the main supply fluid tank is fully seated in the secondary reservoir.

7. The refrigerator of claim 1 comprising a plurality of atomizer compartments, each atomizer compartment comprising an atomizer and a wick.

8. The refrigerator of claim 7 comprising a main wick leading from the secondary reservoir, and an auxiliary wick leading from the main wick to one of the plurality of atomizer compartments.

9. The refrigerator of claim 1 comprising a docking station for accepting the main tank, the secondary reservoir being integrated into the docking station.

10. The refrigerator of claim 1 comprising a modular atomization unit, the modular atomization unit comprising the main tank, the secondary reservoir, the atomizer, and the flexible wick, and the modular atomization unit being removable from the refrigerator as a unit.

11. The refrigerator of claim 10 further comprising an atomization compartment, and wherein the modular atomization unit is located proximate to an upper surface of the atomization compartment.

12. A removable, modular atomization unit for a refrigerator for humidifying at least a portion of the refrigerator, the modular atomization unit comprising a secondary reservoir adapted to accept fluid, the secondary reservoir having a maximum, controlled height of fluid;

an atomizer provided with fluid from the secondary reservoir, the atomizer adapted to discharge the fluid provided from the secondary reservoir in an atomized spray to at least a portion of the refrigerator when the modular atomization unit is deployed in the refrigerator;

a flexible wick disposed between the secondary reservoir and the atomizer and in fluid communication with both the secondary reservoir and the atomizer wherein the atomizer comprises a piezo element located in a piezo reservoir adapted to hold fluid in contact with the piezo element, wherein the piezo reservoir is provided with fluid from the secondary reservoir via the flexible wick; and wherein the modular atomization unit is adapted to be added to or removed from the refrigerator as a unit.

13. The modular atomization unit of claim 12 wherein the flexible wick is securely attached to the piezo element.

14. The modular atomization unit of claim 12 comprising an piezo casing and a wick guide, the piezo casing configured for mounting the atomizer and the wick guide, the wick guide configured for positioning the flexible wick adjacent to the atomizer.

15. The modular atomization unit of claim 12 comprising a secondary reservoir supply valve, the secondary reservoir supply valve being operable to control the supply of fluid.

16. The modular atomization unit of claim 12 wherein the atomizer is located at a greater height than the secondary reservoir when the secondary reservoir is deployed.

17. The modular atomization unit of claim 12 further comprising a main supply tank configured to provide fluid to the secondary reservoir.

18. The modular atomization unit of claim 12 wherein the maximum, controlled height of fluid in the secondary reservoir is not greater than approximately three inches.

19. The modular atomization unit of claim 15 comprising a raised valve actuation element disposed below the secondary reservoir and configured to actuate the secondary reservoir supply valve when the secondary reservoir supply valve is fully seated in the secondary reservoir.

20. A removable, modular atomization unit for a refrigerator for humidifying at least a portion of the refrigerator, the modular atomization unit comprising a main supply tank;

a docking station that receives the main supply tank, the docking station comprising an integral secondary reservoir adapted to accept fluid from a main supply tank, the secondary reservoir having a maximum, controlled height of fluid;

an atomizer unit accepted by the docking station, the atomizer unit comprising an atomizer provided with fluid from the secondary reservoir, the atomizer adapted to discharge the fluid provided from the secondary reservoir in an atomized spray to at least a portion of the refrigerator when the modular atomization unit is deployed in the refrigerator;

a flexible wick disposed between the secondary reservoir and the atomizer and in fluid communication with both the secondary reservoir and the atomizer wherein the atomizer comprises a piezo element located in a piezo reservoir adapted to hold fluid in contact with the piezo element, wherein the piezo reservoir is provided with fluid from the secondary reservoir via the flexible wick; and wherein the modular atomization unit is adapted to be added to or removed from a refrigerator as a unit.

* * * * *